US008839592B2

(12) United States Patent
Foran

(10) Patent No.: US 8,839,592 B2
(45) Date of Patent: Sep. 23, 2014

(54) DUST FREE CONSTRUCTION BARRIER SYSTEM

(76) Inventor: Dana Francis Foran, Bement, IL (US)

( * ) Notice: Subject to any disclaimer, the term of this patent is extended or adjusted under 35 U.S.C. 154(b) by 0 days.

(21) Appl. No.: 13/564,691

(22) Filed: Aug. 1, 2012

(65) Prior Publication Data

US 2014/0033642 A1 Feb. 6, 2014

(51) Int. Cl.
*E04C 2/54* (2006.01)
*E04C 2/00* (2006.01)

(52) U.S. Cl.
USPC ..... 52/782.1; 52/783.1; 52/796.1

(58) Field of Classification Search
CPC ..... E04B 2/827; E04B 2/82; E04B 2/821; E04B 2/7422; E04B 2/7425
USPC ..... 52/782.1, 783.1, 796.1
See application file for complete search history.

(56) References Cited

U.S. PATENT DOCUMENTS

| | | | | |
|---|---|---|---|---|
| 3,685,223 | A * | 8/1972 | Sherwood | 52/64 |
| 4,245,442 | A * | 1/1981 | Durham | 52/126.4 |
| 4,277,920 | A * | 7/1981 | Dixon | 52/64 |
| 5,054,255 | A * | 10/1991 | Maninfior | 52/239 |
| 6,435,253 | B1 * | 8/2002 | Steeves et al. | 160/135 |
| 2002/0117270 | A1 * | 8/2002 | Steeves et al. | 160/135 |
| 2011/0078960 | A1 * | 4/2011 | Luttmann | 52/64 |

* cited by examiner

*Primary Examiner* — Mark Wendell
(74) *Attorney, Agent, or Firm* — Singleton Law Firm, P.C.

(57) ABSTRACT

A panelized, reusable barrier system allowing for containment of construction areas in hospitals and other clean room environments. Panels are adjustable in height from 92" to 120". Panels are available in 12", 24", 36" and 48" widths. Door panels consist of a 44" wide door mounted in a 48" wide panel. Custom clips secure the top of the panels to suspended ceiling grid. Custom camlock fasteners fasten the panels to each other. Hinged corner posts allow for wall transitions ranging from 10° to 90°. Porting options are available to allow for HEPA filtered air discharge and for monitoring differential air pressure between the work area and the public area.

5 Claims, 4 Drawing Sheets

DUST FREE CONSTRUCTION BARRIER SYSTEM

BACKGROUND OF THE INVENTION

Remodel work in hospitals and other clean room environments is common place. Prior to this invention, barrier systems separating the work area from the public area consisted of either a soft type barrier or a hard type barrier.

Soft type barriers consist of a poly sheet material extending from the floor to the ceiling. These barriers should be limited to one day construction projects where the work is completed and the barrier is removed before the workers leave at the end of the day. It's difficult to get a good seal between soft barriers and existing walls, floors and ceilings. Usually the seal is created using tape. Passage through the barrier is typically accomplished with a zipper opening. Workers and material passing through the zipper opening often get caught up and pull the tape loose. The poly material is subject to cuts and tearing. The work area air pressure should be negative to the public area. Negative air pressure causes the poly sheeting to balloon into the work area often breaking the tape seal.

Hard type barriers typically consist of walls built on site with metal studs and drywall. Construction of these walls creates dust so a soft barrier needs to be installed prior to building the hard barrier. Hard barriers require several man hours to build including carpenters, laborers, tapers/painters and possibly an electrician. These barriers can have doors installed in them to allow for workers and material in and out of the work area. Usually the door consists of a hollow metal frame with a wood or steel door. The combination of drywall and a solid door creates a dangerous situation for the public when workers exit the construction area due to the lack of vision. A worker may rapidly open the door into a patient or staff member. The solid wall prevents ambient light from entering the enclosure so temporary lighting is usually required.

At the completion of the project a soft barrier must be reinstalled because of the dust generated by the demolition of the hard barrier. Hard barrier removal requires several more man hours and the material is usually scrapped.

BRIEF SUMMARY OF THE INVENTION

The present invention overcomes the problems encountered with the soft barrier and hard barrier wall systems. This wall system consists of individual panels, in a variety of widths that quickly fasten together without creating any dust or noise. The panels are constructed with an extruded aluminum frame and a tough polycarbonate lens. This panel system typically may be assembled with less than one man hour. Ambient light passes through the panels, creating a pleasant work environment, eliminating the need for temporary lighting. A prefabricated door panel allows for the quick installation of a door with a locking handle and a hydraulic closer. As workers exit the enclosure, patients and staff on the public side can be seen, preventing collisions. Panels adjust in height from 92" to 120". They have gasket material around all edges and around the door creating a fully sealed enclosure. Panels are ridged and very tough. Differential air pressure has no effect on these panels and they will hold up to impacts from hospital carts and beds. This containment system is esthetically pleasing and doesn't require any type of paint or finish. Panels are easily cleaned with a damp cloth and sanitizer.

Enclosure removal is very simple and takes less time than the installation. The panels are completely reusable.

DETAILED DESCRIPTION OF THE INVENTION

Figure 1:
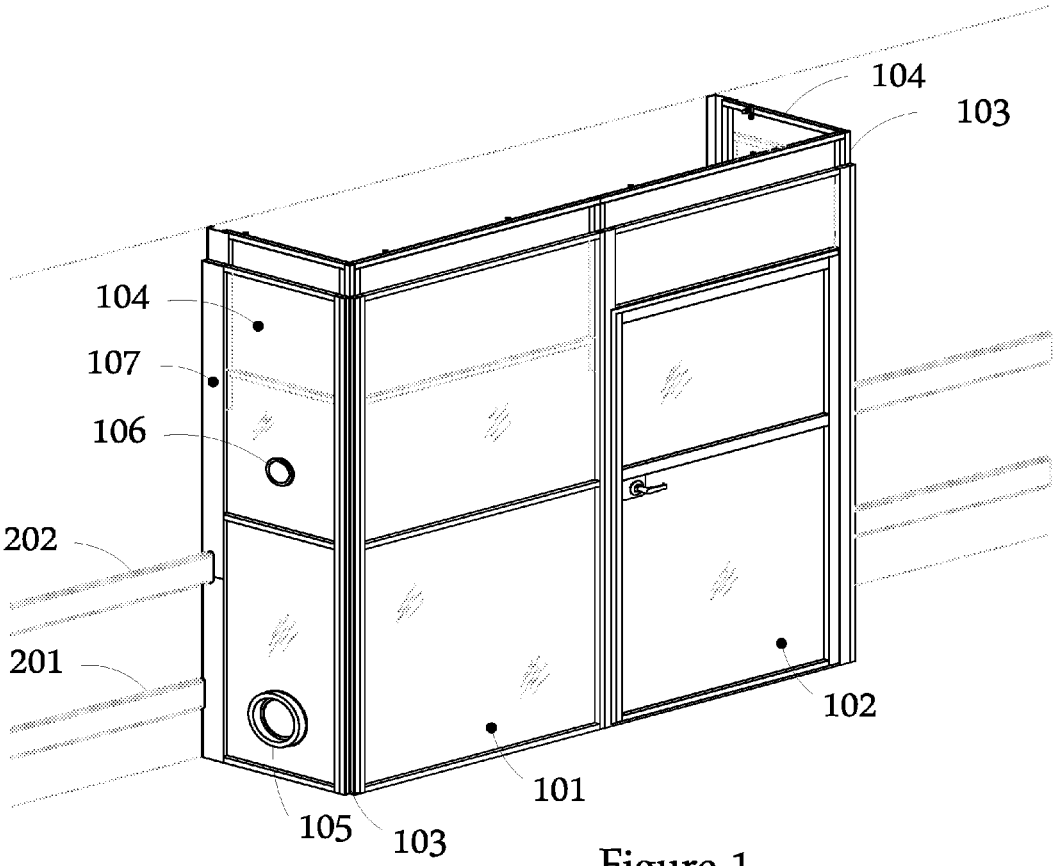
FIG. 1 is an isometric view showing an enclosure assembly commonly used as an anteroom type entrance from a public corridor into a construction area.

Reference will now be made in detail to the presently preferred embodiments of the invention, examples are illustrated in the accompanying drawings. Wherein like reference numerals refer to like elements throughout.

Referring to FIG. 1, the present invention is made up of modular panels with unique functions. The panels may be configured in several ways to create barrier systems for blocking off areas or to create an ante room type enclosure, as shown. 101 depicts a 48" wide solid panel, 102 is a door panel, 103 is the hinged corner post, 104 is a 24" panel which may be a solid panel or configured with porting options, 105 is the porting option for HEPA filtered air discharge (detailed in FIG. 5), 106 is the porting option for a differential pressure gauge. Closure strips 107 are 1/16" thick polycarbonate angles with a 1" leg and a 4" leg. The 1" leg has a ¾"×¾" soft gasket adhered to it that forms a seal to the existing facility wall, the 4" leg is secured to the enclosure system side rails with double sided polyethylene tape and screws. This creates an airtight seal between the enclosure system and the facility walls. 201 and 202 depict handrail and crashrail that are often encountered in hospital corridors. They are not part of the invention.

Figure 2:
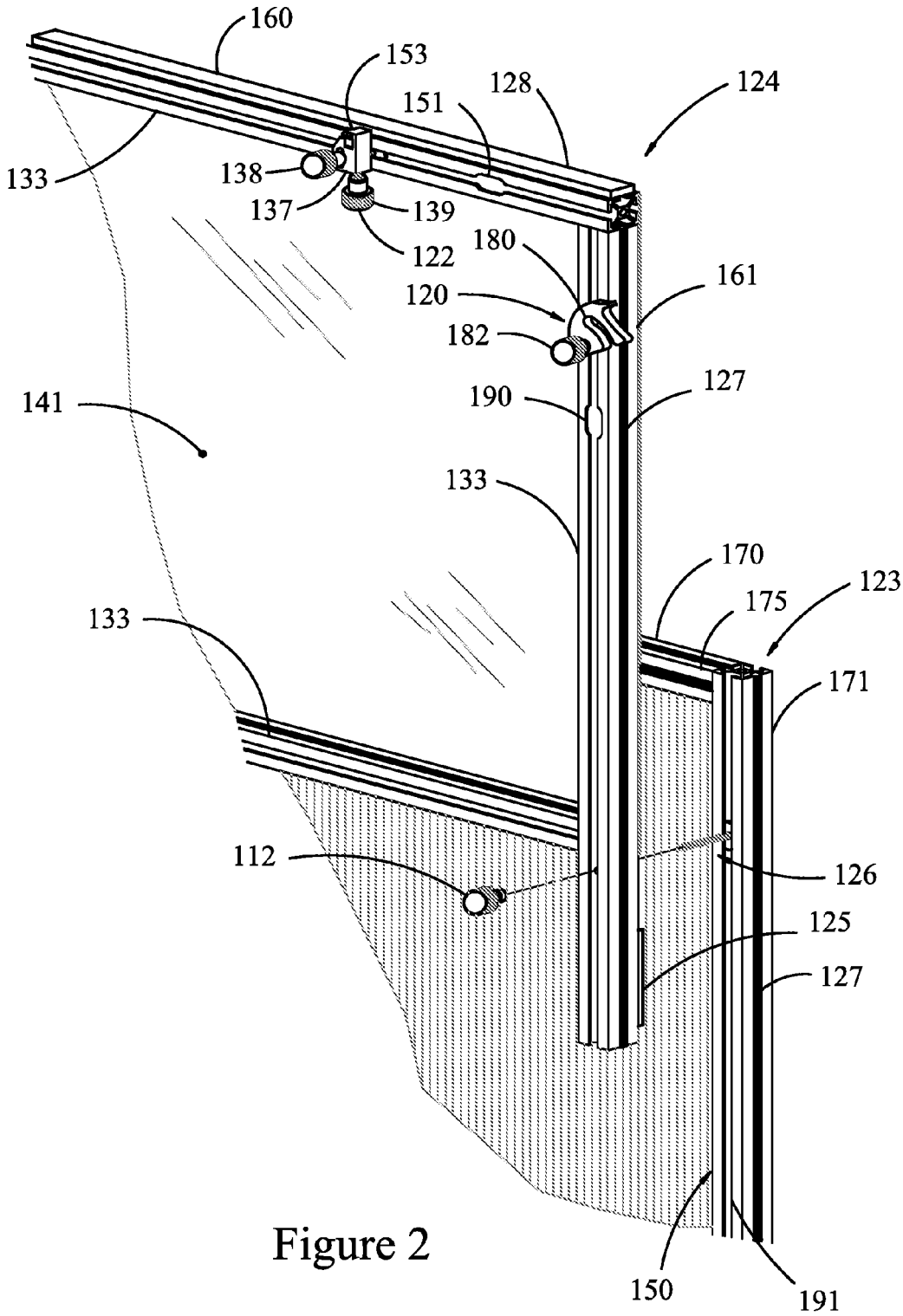
FIG. 2 is an isometric view showing details of how the sliding top panel interacts with the stationary lower panel to allow for panel height adjustment.

Referring to FIG. 2, one of the key features of this invention is having the ability to easily adjust to different ceiling heights. This is accomplished by having an adjustable upper panel assembly 124 that slides up and down on a lower fixed panel assembly 123. The total height adjustment range is 92" to 120". The adjustable upper panel assembly 124 contains an upper panel frame 133. Upper panel frame 133 includes an upper frame top rail 160 and an upper frame side rail 161. A hole opens through the upper panel side rail 161. The lower fixed panel assembly 123 contains a lower panel frame 150 constructed of extruded aluminum. The lower panel frame 150 includes a lower frame top rail 170, a lower frame side rail 171, and a lower frame bottom rail 172 (shown in FIG. 5), where a face of the lower frame top rail 170 defines a lower frame face 175 (shown in FIG. 2). The lower panel frame 150 has continuous slots that encase 6 mm twin wall polycarbonate panels. Upper frame side rail 161 and lower frame side rail 171 have foam gasket material 127 inserted into their outer slots to form a seal with the adjoining panels. The lower frame bottom rail 172 (detailed in FIG. 5) floats in a channel and is supported by a bolt which serves as a pivot point creating a self-leveling channel 130 which conforms to the floor. The bottom of the self-leveling channel 130 has a ⅛"×1" neoprene gasket 132 adhered to it creating a seal between the floor and the self-leveling channel 130. The upper panel frame 133 is constructed of the same extruded aluminum material 133 as the lower panel frame 150, a 1/16" clear polycarbonate sheet 141 is fastened to an upper frame face of the upper panel frame 133 with double sided foam tape and screws. The adjustable upper panel assembly 124 is engaged with the lower fixed panel assembly 123 by mating a tee nut and threaded stud assembly 126 and a knob 112 which has internal threads, as follows: The tee nut of the tee nut and threaded stud assembly 126 is inserted into a lower vertical guide slot 191 of lower frame side rail 171. The adjustable upper panel assembly 124 engages with the lower fixed panel assembly 123 by inserting the threaded stud of the tee nut and threaded stud assembly 126 on lower frame side rail 171 through the hole on upper frame side rail 161 and mating the knob 112 to the tee nut and threaded stud assembly 126. A polyethylene guide block 125 on the upper frame side rail 161 facing the lower fixed panel assembly 123 aids in keeping the adjustable upper panel assembly 124 and the lower fixed panel assembly 123 aligned. The outer side of the upper frame side rail 161 has foam gasket material 127 inserted to form a seal with an adjoining panel. The top of the upper frame top rail 160 has a 1/4"×3/4" soft foam gasket 128 adhered to it to create a seal with a ceiling tile. The panel height is adjusted by loosening the knob 112 from the tee nut and threaded stud assembly 126, and sliding the adjustable upper panel assembly 124 up to a ceiling. When the adjustable upper panel assembly 124 is adjusted to match the ceiling height, the knob 112 is tightened. This creates a seal between the lower frame face 175 of the lower frame top rail 170 and the 1/16" polycarbonate sheet 141 on the upper frame face of the upper panel frame 133. Grid clip assembly 122 (detailed in FIG. 3) secures the adjustable upper panel assembly 124 to a ceiling grid. A camlock fastener assembly 120 (detailed in FIG. 4) locks the side of the panel to other panels and components. Top rail slot 151 and upper vertical guide slot 190 are cut into the upper frame top rail 160 and upper frame side rail 161, respectively, to allow tee nuts to be inserted.

Figure 3:
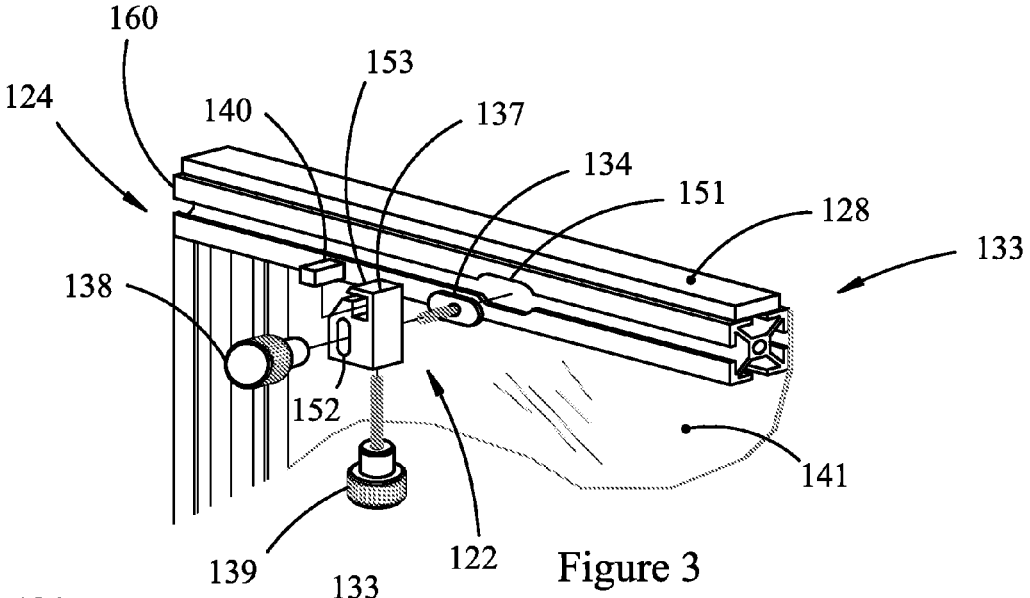
FIG. 3 is an isometric view showing grid clip assembly details.

Referring to FIG. 3, the grid clip assembly 122 secures the upper panel top rail 160 to a suspended ceiling grid. The grid clip body 137 is made of aluminum. The grid clip assembly 122 fastens to the upper frame top rail 160 with a threaded stud 139, tee nut 134 and thumbscrew 138. A top rail slot 151 is machined into the upper panel top rail 160. The tee nut 134 is inserted into top rail slot 151. Tee nut 134 then inserts into the grid clip body slot 152 and attaches to grid clip body 137. Consequently, when grid clip body 137 and tee nut 134 attaches together, grid clip body 137 is also attached to upper frame top rail 160. Thumbscrew 138 attaches to tee nut 134 to secure the grid clip body 137 to upper frame top rail 160. Once the grid clip assembly 122 is attached with the upper panel top rail 160 the grid clip assembly 122 may be positioned at any point along the length of the upper panel top rail 160. The top of the grid clip body 137 hooks onto a ceiling grid and has a low profile as to not raise the ceiling tile. A thumbscrew and threaded stud assembly 139 inserts into the grid clip body 137 from the bottom. A PVC block 140 inserts into grid clip hook 153. The thumbscrew and threaded stud assembly 122 inserts from the bottom of the grid clip body 137 and applies force to a PVC block 140 which applies pressure to the ceiling grid where the ceiling grid is secured between the PVC block 140 and the top of the grid clip body 137. The PVC block 140 prevents damage to the ceiling grid. A top rail soft gasket material 128 having dimensions of 1/4"×3/4" is adhered to the top of the upper panel top rail 160 which creates a seal with the ceiling tile.

Figure 4:
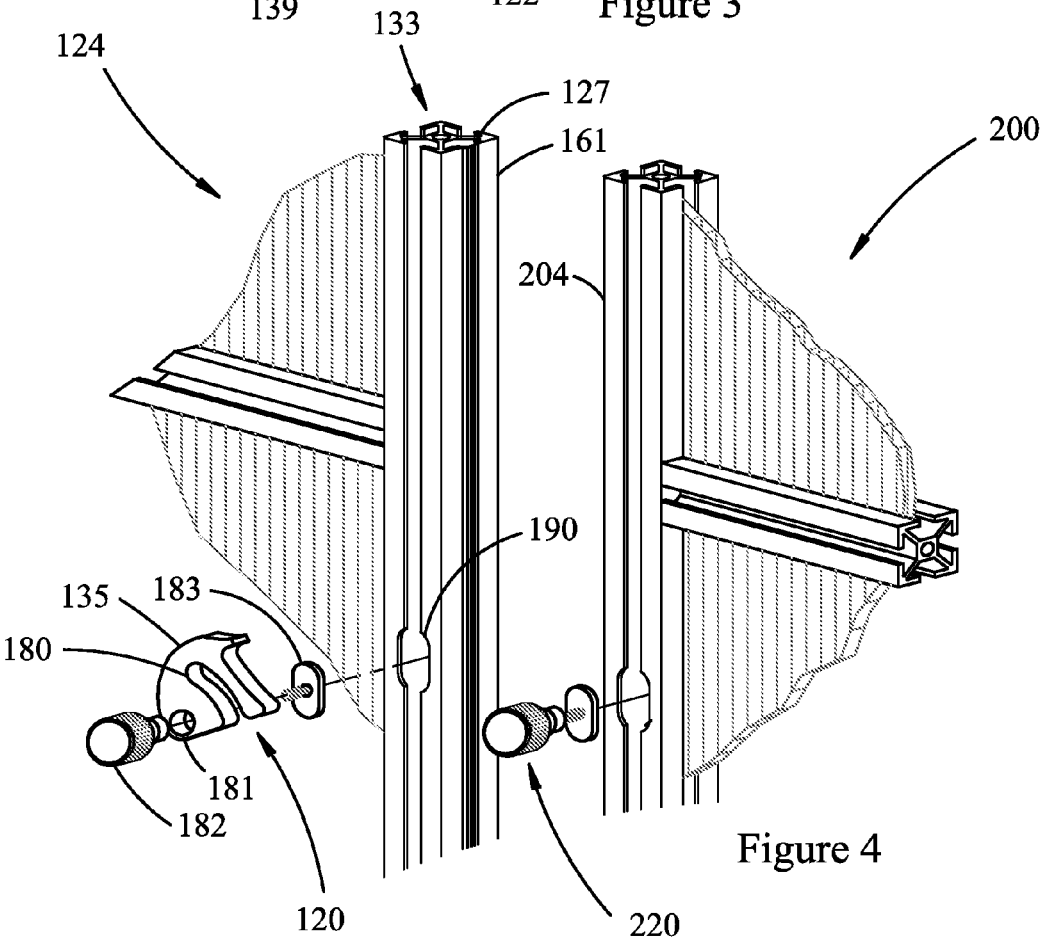
FIG. 4 is an isometric view showing camlock assembly details.

Referring to FIG. 4, the camlock fastener assembly 120 fastens adjoining panels together. The camlock fastener assembly 120 includes a camlock body 135, threaded stud tee nut 183 and camlock thumbscrew 182. The adjoining panel side rail contains a similar combination of a threaded stud tee nut and thumbscrew. The camlock body 135 is made of aluminum. Upper vertical guide slot 190 is machined into upper frame side rail 161 to allow for insertion of threaded stud tee nut 183. Threaded stud tee nut 183 inserts into upper vertical guide slot 190 and attaches to upper panel side rail 161. Threaded stud tee nut 183 and camlock thumbscrew 182 are threaded through camlock slot 181 of camlock body 135. Once inserted into the upper frame side rail 161 the camlock fastener assembly 120 may be positioned at any point along the length of upper panel side rail 161. The camlock body 135 has a radial slot 180 which is not concentric to its pivot point. An adjoining upper panel assembly 200 having an adjoining upper frame rail 204 is placed to the side of upper panel side rail 161. As the radial slot 180 of the camlock body 135 is pushed onto a threaded stud tee nut and thumbscrew assembly 220 of the adjoining upper frame rail 204 it draws the two panels together (detailed in FIG. 1). The upper panel side rail 161 and the adjoining upper frame rail 204 have foam gasket material 127 to create a seal.

Figure 5:
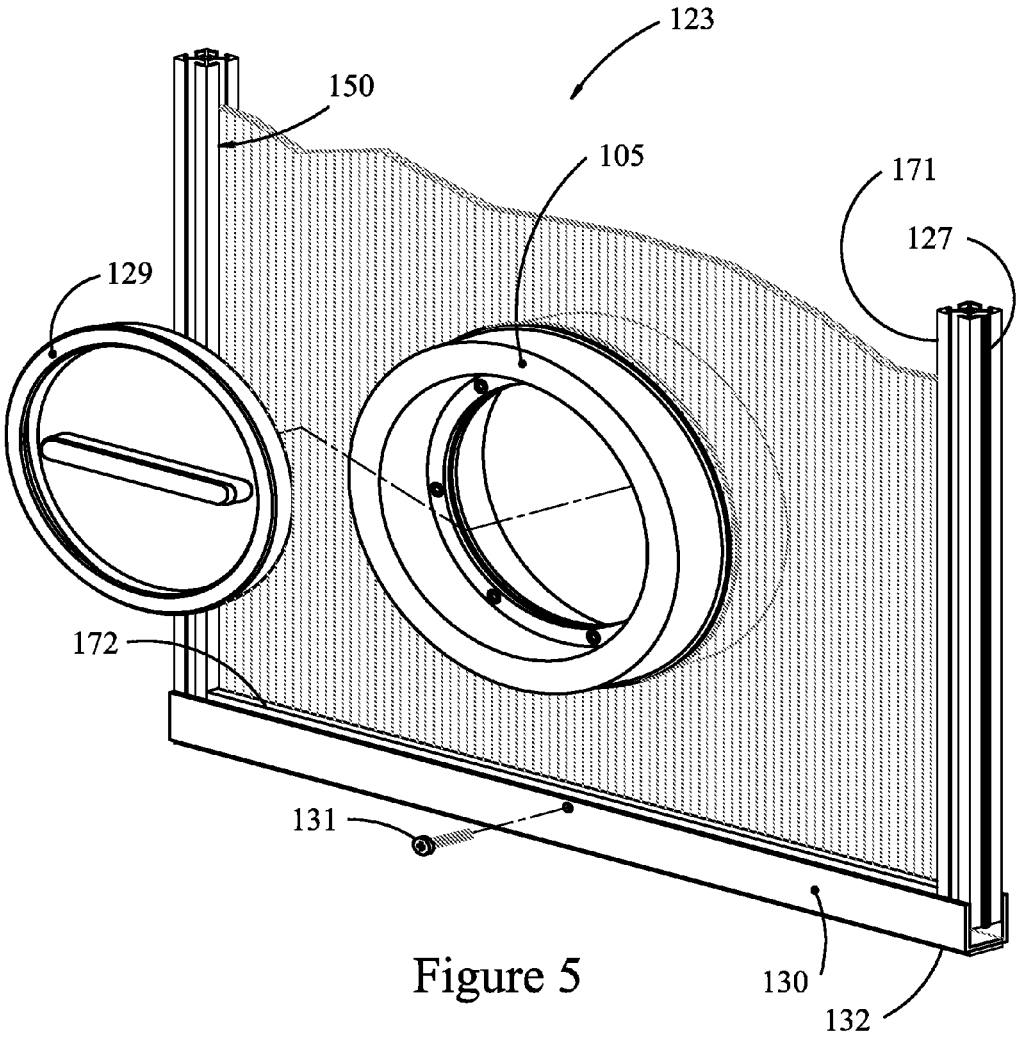
FIG. 5 is an isometric view showing details of the exhaust port and the panel leveling channel.

Referring to FIG. 5, the exhaust port 203 is an optional feature that allows air to be discharged from the contained work space creating negative air pressure compared to the public or clean side of the contained space. The exhaust port ring 105 accepts an 8" diameter exhaust hose internally and a 10" exhaust hose externally. There is a port ring on the inside and outside of the enclosure allowing for different hose connection options. A plug 129 may insert into the exhaust port ring 105. FIG. 5 also shows a self-leveling channel 130 that is typical to all panels other than the door panel. The self-leveling channel 130 fits around the lower panel bottom rail 152 of the lower fixed panel 123. There is a 1/2" space between the bottom of the lower panel bottom rail 152 and the top side of the horizontal leg of the self-leveling channel 130. A pivot bolt 131 passes through the self-leveling channel 130 and the lower panel bottom rail 152 creating a pivot point. In the event of an unlevel floor the panel may be erected level or plumb and the channel will follow the floor. 1/8" neoprene gasket material 132 is adhered to the bottom side of the self-leveling channel 130 creating a seal between the self-leveling channel 130 and the floor.

What I claim:

1. An adjustable panel system, comprising:

an upper panel assembly, the upper panel assembly comprising:

an upper panel frame having an upper frame face, an upper side rail, and a guide block positioned along the upper side rail; and a sheet, wherein the sheet is fastened to the upper frame face;

a lower panel assembly, the lower panel assembly comprising a lower panel frame having a lower frame face and a lower side rail having a lower vertical guide slot;

a tightening member;

and an inserting assembly;

wherein the upper panel assembly and the lower panel assembly are engageable by inserting the inserting assembly into the lower vertical guide slot of the lower side rail, inserting the inserting assembly through the upper side rail, and mating the tightening element with the inserting assembly;

wherein while the upper panel assembly and the lower panel assembly are engaged, and while the tightening member is loosened on the inserting assembly, the upper panel assembly is slidable on the lower panel assembly;

wherein while the upper panel assembly and the lower panel assembly are engaged, and while the tightening member is tightened on the inserting assembly, the sheet and the lower frame face form a seal.

2. The system of claim 1, further comprising a grid clip assembly;

wherein the upper panel assembly further comprises a top rail;

wherein the grid clip assembly is fastenable to the top rail;

wherein the grid clip assembly is securable to a ceiling grid of a ceiling, wherein the ceiling further comprises a ceiling tile;

wherein while the grid clip assembly is fastened to the top rail and to the ceiling grid of the ceiling, the top rail and the ceiling tile form a seal.

3. The system of claim 1, further comprising a leveling channel conforming to a floor;

wherein the lower panel assembly further comprises a bottom rail;

wherein the bottom rail is pivotably fastenable to the leveling channel.

4. The system of claim 1, further comprising a closure strip having a first leg and a second leg;

wherein a seal is formed between the adjustable panel system and a wall by securing the first leg to the wall and securing the second leg to the upper side rail and to the lower side rail.

5. The system of claim 1, further comprising:

a cam lock, and an adjoining upper panel assembly comprising an adjoining upper frame rail;

wherein the cam lock is securable to the upper rail and the adjoining upper frame rail such that the upper rail and the adjoining upper frame rail form a seal.

* * * * *